US008251052B2

(12) United States Patent
Smith

(10) Patent No.: US 8,251,052 B2
(45) Date of Patent: Aug. 28, 2012

(54) BRICK CUTTING APPARATUSES AND METHODS

(75) Inventor: Steven George Smith, St. Michael, MN (US)

(73) Assignee: VAST Enterprises, LLC, Minneapolis, MN (US)

( * ) Notice: Subject to any disclaimer, the term of this patent is extended or adjusted under 35 U.S.C. 154(b) by 258 days.

(21) Appl. No.: 12/395,825

(22) Filed: Mar. 2, 2009

(65) Prior Publication Data

US 2010/0218752 A1 Sep. 2, 2010

(51) Int. Cl.
*B28D 1/22* (2006.01)

(52) U.S. Cl. ..... 125/23.01

(58) Field of Classification Search ..... 125/23.01
See application file for complete search history.

(56) References Cited

U.S. PATENT DOCUMENTS

| | | | | | |
|---|---|---|---|---|---|
| 413,348 | A | * | 10/1889 | Marks | 125/23.01 |
| 1,134,217 | A | * | 4/1915 | Munro | 125/23.01 |
| 1,446,726 | A | * | 2/1923 | Sloan | 83/169 |
| 1,503,829 | A | * | 8/1924 | Heald | 83/125 |
| 1,734,934 | A | * | 11/1929 | Wineman | 125/23.01 |
| 1,825,420 | A | * | 9/1931 | Rand | 125/23.01 |
| 2,294,113 | A | | 8/1942 | Gohr | |
| 2,440,773 | A | | 5/1946 | Hostetter | |
| 2,772,671 | A | * | 12/1956 | Nowak et al. | 125/23.01 |
| 2,779,324 | A | * | 1/1957 | Schlough et al. | 125/23.01 |
| 3,026,865 | A | * | 3/1962 | Sunada | 125/23.01 |
| 3,523,365 | A | | 8/1970 | Bengal et al. | |
| 4,030,387 | A | | 6/1977 | Finnimore | |
| 4,436,501 | A | | 3/1984 | Kenworthy | |
| 4,541,405 | A | * | 9/1985 | Schlough | 125/23.01 |
| 4,646,598 | A | | 3/1987 | Lineberry et al. | |
| 4,939,968 | A | * | 7/1990 | Stoof | 83/886 |
| 5,626,124 | A | * | 5/1997 | Chen | 125/23.02 |
| 5,901,763 | A | * | 5/1999 | You | 144/286.5 |
| 6,273,081 | B1 | | 8/2001 | Gorgol et al. | |
| 6,892,616 | B2 | * | 5/2005 | Yasoda et al. | 83/62.1 |
| 6,932,075 | B1 | * | 8/2005 | Tsao | 125/13.01 |
| 7,107,982 | B1 | * | 9/2006 | Lechner | 125/23.01 |
| 7,344,334 | B2 | | 3/2008 | Thorkelson | |
| 2010/0101552 | A1 | * | 4/2010 | Tesh et al. | 125/23.01 |

* cited by examiner

*Primary Examiner* — Maurina Rachuba
(74) *Attorney, Agent, or Firm* — Schwegman, Lundberg & Woessner, P.A.

(57) ABSTRACT

This document discusses, among other things, apparatuses and methods for cutting a brick including a base configured to selectively support the brick. An actuating assembly is movable along a cutting line. The actuating assembly is movable by a cutting distance at least equal to a height of the brick. A shear blade is removably attached to the actuating assembly. The shear blade is movable with the actuating assembly along the cutting line. The shear blade is configured to shear the brick along the cutting line when moved toward the base through the brick.

22 Claims, 6 Drawing Sheets

BRICK CUTTING APPARATUSES AND METHODS

BACKGROUND

Paver systems are frequently used in landscaping and outdoor construction. Landscape pavers are widely used today in residential, commercial, and municipal applications that include walkways, patios, parking lots, and streets. Stone and brick provide an historical aesthetic value but are expensive and not suitable for some applications. In most cases, these pavers are made from a cementitious mix (e.g., concrete) or clay and are traditionally extruded, molded, or cast into various shapes. These are heavy and can be difficult to install, due both to weight and geometrical configuration.

Although cementitious pavers are widely used throughout the landscape industry, the materials prevent cost effective, mass production of complex shapes. Because of the constraints of the materials and corresponding manufacturing process, the most typical shapes include simple rectangular or octagon blocks with little aesthetic value and limited variability. Further, finely detailed features and precision dimensions cannot efficiently be formed on such blocks. In addition, their weight and typical designs deter efficient installation. The typical manner of installing cementitious or clay pavers is labor intensive, time consuming, and generally includes substantial overhead equipment costs. The simple shapes of cementitious or clay pavers limit their installation to an intensive manual process.

Further, the weight of the cementitious or clay pavers causes the pavers to be inefficient to transport. Trucks are "underloaded," due to reaching weight restrictions before volume restrictions, thereby inflating transportation costs. Additionally, trucks, or other transport devices loaded with cementitious or clay pavers are heavy and may not be driven over soft surfaces, such as a yard, without risk of deforming the surface.

The inherent nature of the cementitious and clay pavers results in high installation and transportation costs. These costs contribute to restricting the manufacturing process to be 'simple' and inexpensive to be cost effective on a total installed cost basis as compared to poured concrete or asphalt alternatives. Thus, in general, the entire cementitious paver process is in a cycle that deters the evolution of the product.

Cutting of cementitious and clay pavers can also be problematic. For instance, saws and other devices for cutting cementitious and clay pavers are often powered. Such powered saws and other devices require a power source, such as gas, electric, or another such power source. Moreover, cutting cementitious and clay pavers with a rotary saw, for instance, often creates a fairly large amount of noise and dust.

For many residential and commercial construction applications, it would be desirable to have the aesthetic value that concrete, brick, or clay pavers offer without the substantial logistic, overhead, and labor implications inherent with these systems. In addition, it would be desirable to have products for walkway/driveway/parking lot systems that promote environmental stewardship, are environmentally friendly, and enhance safety. It would also be desirable to have a device for cutting bricks and pavers which reduces or eliminates the above-stated disadvantages of powered saws and other such devices.

OVERVIEW

The present inventor has recognized, among other things, that there exists a need for a brick cutting apparatus that allows for shearing of bricks, such as, for instance, polymeric paver bricks.

In some embodiments, an apparatus for cutting a brick includes a base configured to selectively support the brick. An actuating assembly is movable along a cutting line. The actuating assembly is movable by a cutting distance at least equal to a height of the brick. A shear blade is removably attached to the actuating assembly. The shear blade is movable with the actuating assembly along the cutting line. The shear blade is configured to shear the brick along the cutting line when moved toward the base through the brick.

In some embodiments, a method of cutting a polymeric brick includes positioning the polymeric brick with respect to a cutting apparatus to align a portion of the polymeric brick to be cut with a cutting line of the cutting apparatus. A shear blade of the cutting apparatus is actuated to move along the cutting line and shear the polymeric brick substantially along the cutting line. Actuating the shear blade includes actuating a mechanical advantage device to provide sufficient force to press the shear blade through the polymeric brick.

In some embodiments, a method of cutting a brick includes fixedly attaching a first shear blade to a manual cutting apparatus. The first shear blade includes a first blade profile. The brick is positioned with respect to the cutting apparatus to align a portion of the brick to be cut with a cutting line of the cutting apparatus. The first shear blade of the cutting apparatus is manually actuated to move along the cutting line and shear the brick substantially along the cutting line to cut the brick in a pattern corresponding to the first blade profile. The first shear blade is removed. A second shear blade is fixedly attached to the cutting apparatus. The second shear blade includes a second blade profile different from the first blade profile. The second shear blade of the cutting apparatus is manually actuated to move along the cutting line and shear the brick substantially along the cutting line to cut the brick in a pattern corresponding to the second blade profile.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The present inventor has recognized, among other things, that there exists a need for a relatively portable device for cutting paver pieces or bricks, in particular polymeric paver bricks. The present inventor has also recognized that there exists a need for a device for cutting paver bricks that does not require a power source, such as electricity, a gas-powered engine, or the like.

The subject matter described herein may take form in various components and arrangements of components, and in various procedures and arrangements of procedures. The simplified drawings are only for purposes of conveying the basic design intent and illustrating various examples of the invention and are not to be construed as limiting the invention.

Figure 7:
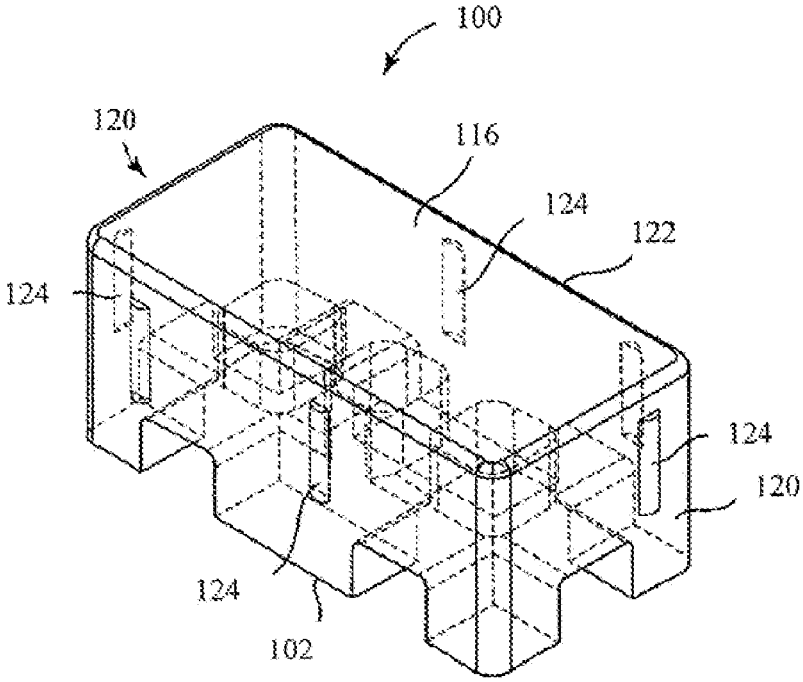
FIG. 7 is a perspective view of a brick configured to be cut by an apparatus according to some embodiments of the disclosed subject matter.

Referring initially to FIG. 7, in an example, paver pieces or bricks 100 can be formed of a polymeric material. In certain examples, the material of the paver brick 100 can be formable and relatively lightweight. In some examples, the material of the paver brick 100 can be a composite with materials held in a matrix with polymer binders. In certain examples, various formable, relatively lightweight polymeric materials may be used, for example a composite of rubber and plastic. In one example, the paver brick 100 can be manufactured using a composite polymeric material from recycled materials, for instance, a combination of recycled rubber from tires and recycled plastics such as polypropylene (PP) and/or high density polyethylene (HDPE).

In contrast to brittle, cementitious materials previously used for paving systems, the formable, relatively lightweight material permits precise forming or configuring of the paver pieces 100, including protrusions and sharp corners less suitable for cementitious or clay-based materials. Further, in some examples, the lightweight material is somewhat elastic to permit deformation of the paver system over small protrusions and flex of the paver system over non-level surfaces. Thus, in contrast to cementitious or clay paver systems wherein the pavers may crack or break when subjected to tensile stress or bending load, the polymeric paver pieces 100 can resist such damage.

In some examples, the paver piece or brick 100 includes a generally rectangular form. However, in other examples, a paver piece or brick can be shaped in any manner with different geometric shapes, such as squares, hexagons, triangles, or the like. In one example, each paver piece 100 includes a coupling feature for coupling with a complementary coupling feature of a substrate so that the paver pieces 100 mate with the substrate.

As shown in FIG. 7, the rectangular paver piece 100 has a generally flat top surface 116 and a bottom surface 102. The bottom surface 102, in some examples, is configured with features for coupling with at least one substrate. The paver piece 100 has end walls 120 and side walls 122. In one example, two spacers 124 are provided on each of the side walls 122 and one spacer 124 is provided on each of the end walls 120. In some examples, spacers may be otherwise provided or may not be provided. In one example, the spacers 124 provide, at least, space for sand-locking between paver pieces 100.

Figure 1:
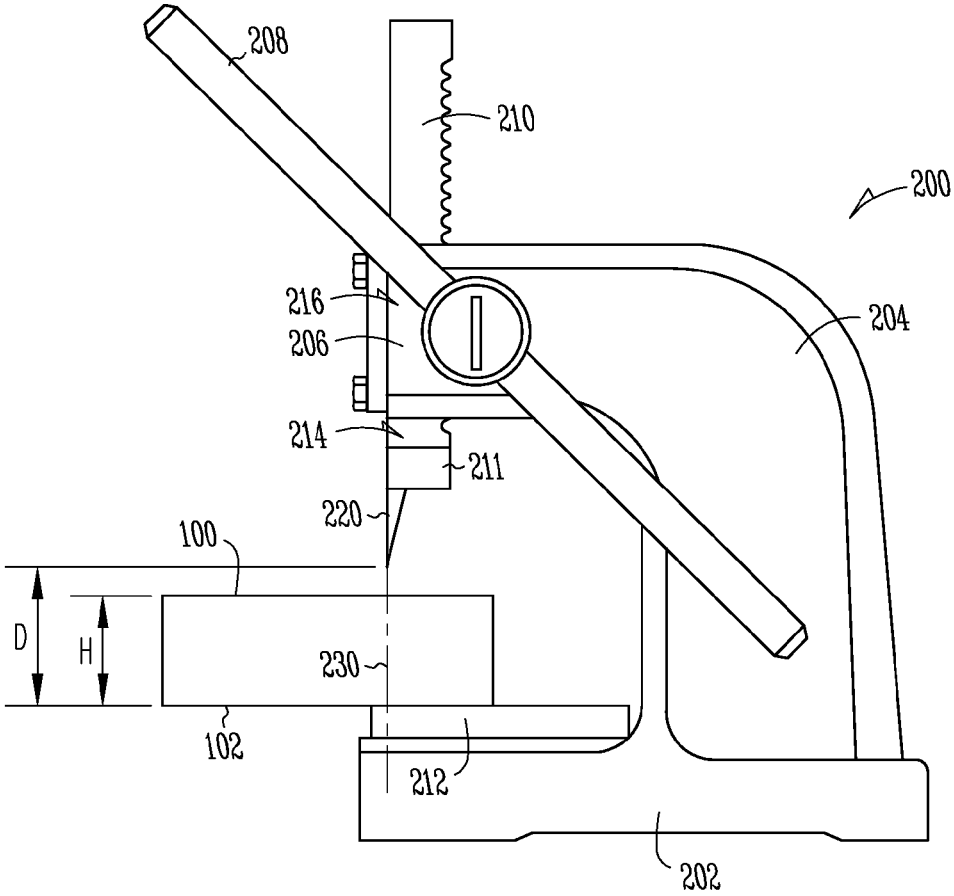
FIG. 1 is a side view of an apparatus for cutting a brick according to some embodiments of the disclosed subject matter.
Figure 2A:
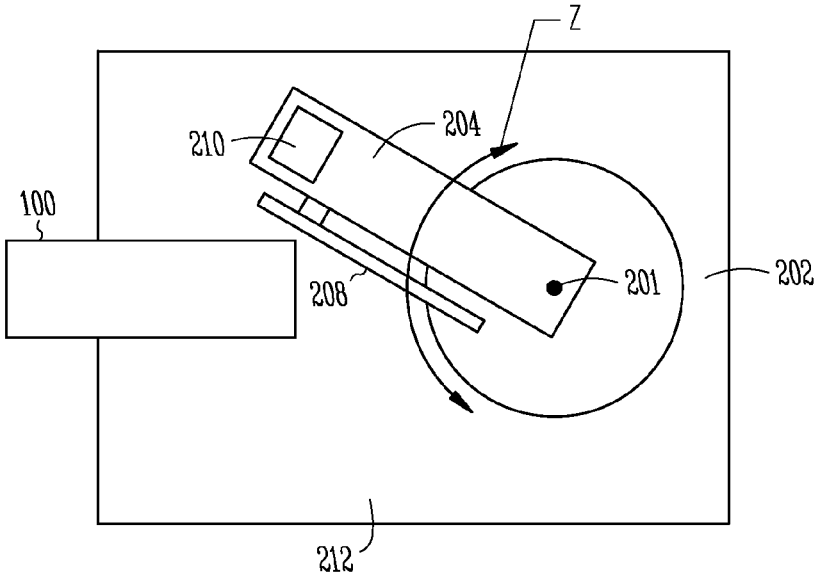
FIG. 2A is a top view of an apparatus for cutting a brick according to some embodiments of the disclosed subject matter.
Figure 2B:
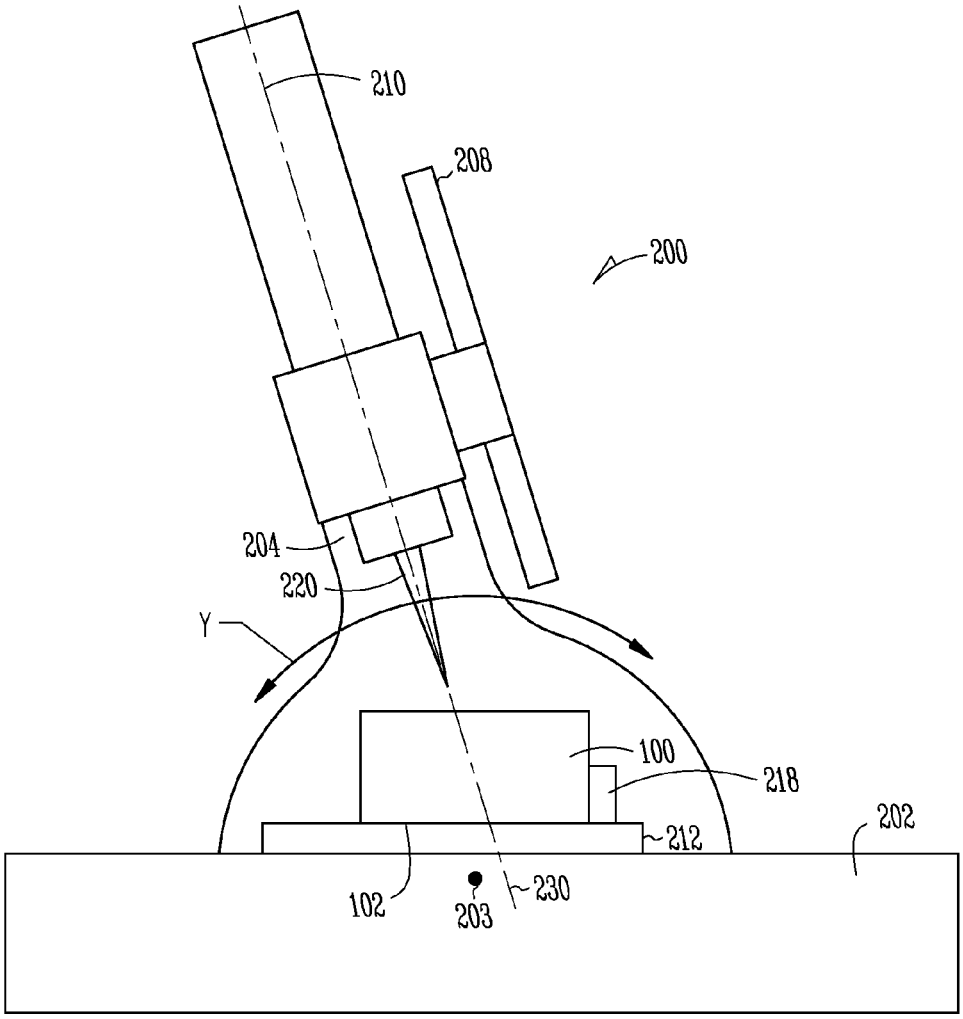
FIG. 2B is a front view of an apparatus for cutting a brick according to some embodiments of the disclosed subject matter.

Referring now to FIGS. 1, 2A, and 2B, an example of an apparatus 200 for cutting a brick 100, such as a polymeric brick, as described above. In the example shown in FIG. 1, the apparatus 200 includes an arbor press configuration. However, in other examples, the apparatus for cutting a brick can include other configurations, including other shear tool configurations. The apparatus 200 includes a base 202 to support the apparatus 200 on a surface, such as, for instance, a top of a workbench, the ground, a bed of a pickup truck, or another such surface. In some examples, the base 202 includes a platform 212 configured to selectively support the brick 100. In various examples, the platform 212 can be integrally connected with the apparatus 200, removably attached to the apparatus 200, or otherwise associated with the apparatus 200. It is noted that the platform 212 need not be of a particular shape or configuration and, in this example, need only provide brick support during a cutting operation. In other examples, a surface of the base 202 or another surface can be configured to selectively support the brick 100 during a cutting operation. Although cutting operations are described herein with respect to "the brick 100", it is noted that cutting operations described herein can be performed on one brick 100, more than one brick 100 at the same time, or one or more partial bricks, either individually or at the same time.

In some examples, the apparatus 200 includes an arm 204 extending outwardly from the base 202. The arm 204 can extend from a top surface of the base 202, in some examples, although other configurations are contemplated in other examples. In one example, the arm 204 extends upwardly from the base 202 and is curved or otherwise angled to allow the arm 204 to extend over the platform 212 or other surface of the base 202 configured to support the brick 100.

The arm 204 includes a cutting mechanism 214 attached thereto. In one example, the cutting mechanism 214 is attached to an end of the aim 204 distal from the base 202. In a further example, the cutting mechanism 214 is disposed over the platform 212 or other surface configured to support the brick 100 during cutting. In some examples, the cutting mechanism 214 includes various components including an actuating assembly 210, a mechanical advantage device 216, and a shear blade 220.

In some examples, the actuating assembly 210 is movable along a cutting line 230, which is configured to traverse through a brick 100 disposed on the platform 212 or other surface configured to support the brick 100 during cutting. The actuating assembly 210, in one example, is movable by a cutting distance D at least equal to a height H of the brick 100. In one example, the actuating assembly 210 includes a rack 210 translationally disposed with respect to the arm 204. The rack 210 of this example is configured to have a stroke of at least the cutting distance D with respect to the arm 204. In other examples, the actuating assembly can include structures other than a rack, such as, for instance, a sliding rod, beam, or member driven by a crank, for instance. In an example, the actuating assembly 210 is manually powered to move along the cutting line 230, as will be described below.

In some examples, the actuating assembly 210 includes a connection assembly 211 disposed thereon for connection of the shear blade 220. Various configurations of connection assemblies 211 are contemplated herein, including, but not limited to, a threaded connection; a snap-on connection, such as a detent, a spring-loaded ball bearing arrangement, or the like; a frictional fit; a keyed shaft with or without a set screw or other fastening means; etc. Depending upon the configuration of the connection assembly 211 of the actuating assembly 210, in various examples, the shear blade 220 includes a corresponding or otherwise complementary connection assembly to allow attachment and reattachment of various shear blades 220.

Referring specifically to FIGS. 2A and 2B, in some examples, the actuating assembly 210 is selectively pivotable with respect to the platform 212, base 202, or other surface configured to support the brick 100 during a cutting operation. In one example, the actuating assembly 210 is selectively pivotable about an axis 201 substantially normal to the platform 212. In the example shown in FIG. 2A, the arm 204 is pivotable with respect to the base 202, such that the arm 204 is selectively pivotable along arrow Z to place the shear blade 220 at various angles with respect to the platform 212, base 202, or other surface configured to support the brick 100 during a cutting operation. In some examples, the arm 204 can be constrained at various angles along arrow Z using various methods, such as a set screw or fastening lug, a latch, pin and hole configurations, and the like. In further examples, markings can be disposed on the base 202 or around the pivoting portion of the arm 204 in a manner to identify the pivot angle along arrow Z of the arm 204, actuating assembly 210, and/or shear blade 220.

In another example, an angle of the cutting line 230 is selectively adjustable with respect to the platform 212, base 202, or other surface configured to support the brick 100 during a cutting operation. For instance, referring to FIG. 2B, the arm 204 can be selectively pivoted with respect to the base 202 about an axis 203. In this way, the cutting line 230 can be selectively adjusted at various angles along arrow Y to the platform 212, base 202, or other surface configured to support the brick 100 during a cutting operation. In one example, a chamfer cut of a brick 100 can be performed if the arm 204 is disposed at angles other than ninety degrees to the platform 212, base 202, or other surface configured to support the brick 100 during a cutting operation. In another example, a straight cut of a brick 100 can be performed if the arm 204 is disposed substantially at ninety degrees to the platform 212, base 202, or other surface configured to support the brick 100 during a cutting operation. In some examples, the arm 204 can be constrained at various angles along arrow Y using various methods, such as a set screw or fastening lug, a latch, pin and hole configurations, and the like. In further examples, markings can be disposed around the pivoting portion of the arm 204 in a manner to identify the pivot angle along arrow Y of the arm 204, actuating assembly 210, and/or shear blade 220.

In some examples, a stop block 218 or other retention device is attached to the base 202 or platform 212 and is used to inhibit the brick 100 from sliding with respect to the apparatus 200 during a chamfer cut, for which the arm 204 is disposed at an angle along arrow Y other than ninety degrees. In one example, the stop block can be adjusted or repositioned to restrain the brick 100 during various angled or straight cutting operations. In other examples, the platform 212 can include a frictional surface to inhibit movement of bricks 100 during chamfer cutting operations. Such frictional surfaces include, but are not limited to, surfaces having a grit (akin to sand paper, for instance), treaded surfaces, surfaces having raised bumps, surfaces having raised ridges, or combinations thereof.

In further examples, rather than the arm 204 being pivotable about axes 201, 203, the platform 212 can be pivotable and rotatable with respect to the base 202 to achieve different orientations of the brick 100 with respect to the actuating assembly 210, shear blade 220, or cutting line 230.

Referring again to FIGS. 1, 2A, and 2B, the cutting mechanism 214, in some examples, includes the mechanical advantage device 216. The mechanical advantage device 216, in various examples, includes various components, as described below, and is configured to allow for a stroke long enough to traverse at least the thickness of a brick 100, while, at the same time, allowing for a manual force for operation of the apparatus 200 that is capable of being applied by a user. In further examples, the mechanical advantage device 216 is configured to increase force exerted by the shear blade 220 on the brick 100 during cutting, with the force being sufficient to shear the brick 100.

In some examples, the mechanical advantage device 216 includes a reduction gearbox 206 to amplify the force applied by the user, thereby increasing the force exerted by the shear blade 220. The reduction gearbox 206 includes a series of gears and operates to increase the amount of force exerted at an output end (here, the shear blade 220) from the force applied at an input end. In some examples, the reduction gearbox 206 includes a worm to engage and cause movement of the rack 210. In some examples, the reduction gearbox 206 includes one or more gears in addition to or instead of the worm, depending on the amount of reduction desired. For instance, in one example, the reduction gearbox 206 includes a series of engaged spur gears ending with a pinion that engages and moves the rack 210. In another example, the reduction gearbox 206 includes a single gear that engages and moves the rack 210. The above examples of reduction gearboxes are not intended to be limiting, however, as various other configurations of the reduction gearbox 206 are contemplated herein.

In some examples, the mechanical advantage device 216 includes a lever arm 208 to amplify the force applied to the lever arm 216 so as to increase the amount of force exerted by the shear blade 220. In various examples, the lever arm 208 can be used with or without the reduction gearbox 206. In some examples, the lever arm 208 is the input to the reduction gearbox 206 that is manually operated by the user during a cutting operation. The amount of mechanical advantage offered by the lever arm 208 is determined by and proportional to a length of the lever arm 208. The mechanical advantage device 216, in other examples, can include various other inputs other than a lever arm. For instance, a manually-powered crank wheel or crank arm can be used. In other examples, the input can be powered to power movement of the rack 210. For instance, in one example, a drill can be coupled to the input of the mechanical advantage device 216 to power the cutting operation of the apparatus 200.

The cutting mechanism 214 includes various examples of shear blades 220, depending upon the type of cut desired, the type of brick 100 being cut, and the size of brick 100 being cut. The shear blade 220, in some examples, is removably attached to the actuating assembly 210, as discussed above. The shear blade 220 can include a connection assembly that is complementary to the connection assembly 211 of the actuating assembly 210 to allow for attachment and removal of the shear blade 220. In some examples, the shear blade 220 is movable with the actuating assembly 210 along the cutting line 230. In various examples, the shear blade 220 is configured to shear the brick 100 along the cutting line 230 when moved toward the platform 212 (or other surface configured to support the brick 100 being cut) through the brick 100. Different examples of shear blades 220 include variously shaped cutting edges. In one example, such differently shaped cutting edges of the shear blades 220 allow for the user to choose different shear blades 220 according to what type of cut is desired.

Figure 3:
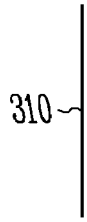
FIGS. 3-6 are views of shear blade edges of an apparatus for cutting a brick according to some embodiments of the disclosed subject matter.
Figure 4:
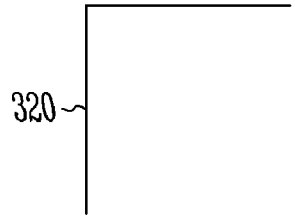
Figure 5:
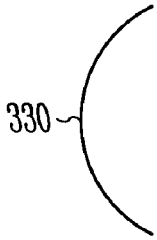
Figure 6:
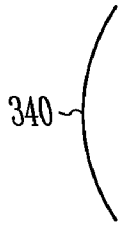

Referring to FIGS. 3-6, some examples of cutting edges of shear blades are shown. Referring to FIG. 3, in one example, the shear blade includes a substantially straight cutting edge 310 for cutting a substantially straight cut through a brick 100, for instance. Referring to FIG. 4, in a further example, the shear blade includes an angled cutting edge for cutting a notch out of a brick 100 or for cutting an L-shape or T-shape into the brick 100, for instance. Although the cutting edge 330 includes a substantially right angle profile, in further angled examples, different angles of the cutting edge are contemplated, such as, for instance greater than or less than ninety degrees. Referring to FIGS. 5 and 6, in still further examples, the shear blade includes curved cutting edges 330, 340 for cutting curved lines in the brick 100, for instance. The cutting edge 330 differs from the cutting edge 340 in that each cutting edge 330, 340 includes a different radius of curvature. It is contemplated herein that further examples of curved cutting edges include other radii of curvature that are different from those shown in FIGS. 5 and 6. In other examples, still further examples of shapes of cutting edges are contemplated. Such further examples depend upon the application and desired effect and include various shapes and patterns, such as wave patterns, zig-zag patterns, closed perimeters (rectangles, triangles, circles, ovals, etc.) for cutting holes through bricks 100), and the like.

In some examples, different shear blades 220 are interchangeable and can be used to make variously-shaped cuts in one brick 100 or multiple bricks 100. In one example, one shear blade 220 includes a cutting edge having a first shape to cut a brick 100. The shear blade 220 is configured to be removed from the actuating assembly 210, as described above, and replaced with a second shear blade 220 including a cutting edge having a second shape to cut the same brick 100 or to cut another brick 100. In this way, the user can create intricate cuts in a single brick 100 or can make differently shaped cuts in different bricks 100.

In various examples, the apparatus 200 can be constructed from various materials. It is contemplated that the apparatus 200 is relatively light and portable to facilitate transportation and carrying of the apparatus to various job sites and the like. Also, because, in some examples, the apparatus 200 is intended to be used to cut polymeric bricks 100, the forces required to be generated and withstood by the apparatus are not as great as those required for cutting harder or stronger objects. As such, in various examples, it is contemplated that relatively lightweight materials be used to construct the apparatus 200. Such materials include, but are not limited to, sheet metal; high strength polymeric materials or plastics, such as nylon, for instance; composite plastics, wood; aluminum; or any other relatively lightweight, manually transportable material capable of structurally supporting the forces created during a cutting operation for a polymeric brick 100. Various combinations of these materials are contemplated in further examples of the apparatus 200.

Figure 8:
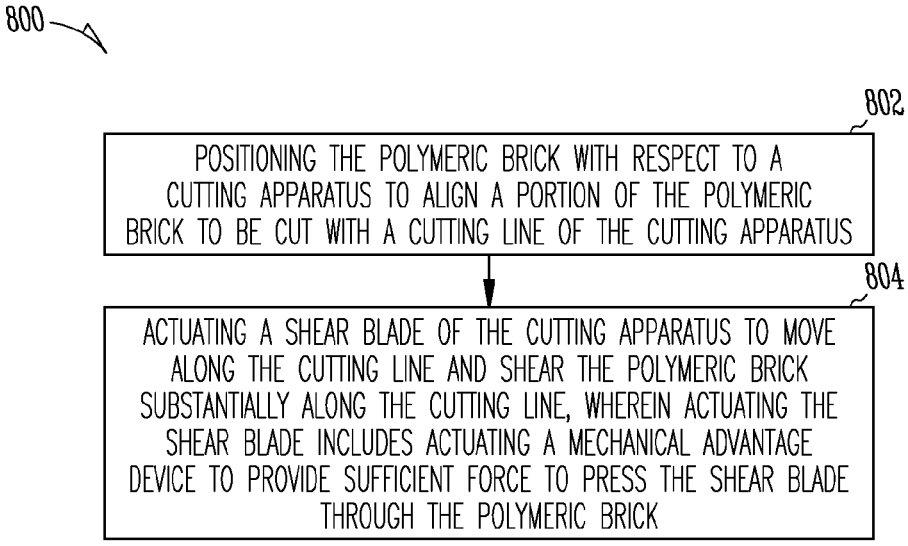
FIG. 8 is a diagrammatic view of a method of cutting a brick according to some embodiments of the disclosed subject matter.

With continued reference to FIGS. 1-7 and the above description, in a further example, a method 800 of cutting a polymeric brick 100 is shown in FIG. 8. At 802, the polymeric brick 100 can be positioned with respect to a cutting apparatus 200 to align a portion of the polymeric brick 100 to be cut with a cutting line 230 of the cutting apparatus 200. At 804, a shear blade 220 of the cutting apparatus 200 can be actuated to move along the cutting line 230 and shear the polymeric brick 100 substantially along the cutting line 230. In an example, actuating the shear blade 220 includes actuating a mechanical advantage device 216 to provide sufficient force to press the shear blade 220 through the polymeric brick 100. In one example, the shear blade 220 is actuated by rotating a lever arm 208. In one example, the shear blade 220 is manually actuated. In other examples, the actuation of the shear blade 220 can be powered using, for instance, a drill. In another example, the shear blade 220 is moved by a cutting distance D at least equal to a height H of the polymeric brick 100.

In an example, the method 800 includes fixedly attaching the shear blade 220 to the cutting apparatus 200. In a further example, the shear blade 220 can be removed and replacing with a different shear blade 220 having a profile different than a profile of the removed shear blade 220. In this way, differently shaped cuts can be performed using the same cutting apparatus 200, as was described above. In some examples, the method 800 further includes selectively pivoting the shear blade 220 with respect to the polymeric brick 100 to adjust the cutting line 230 with respect to the polymeric brick 100, as described above.

Figure 9:
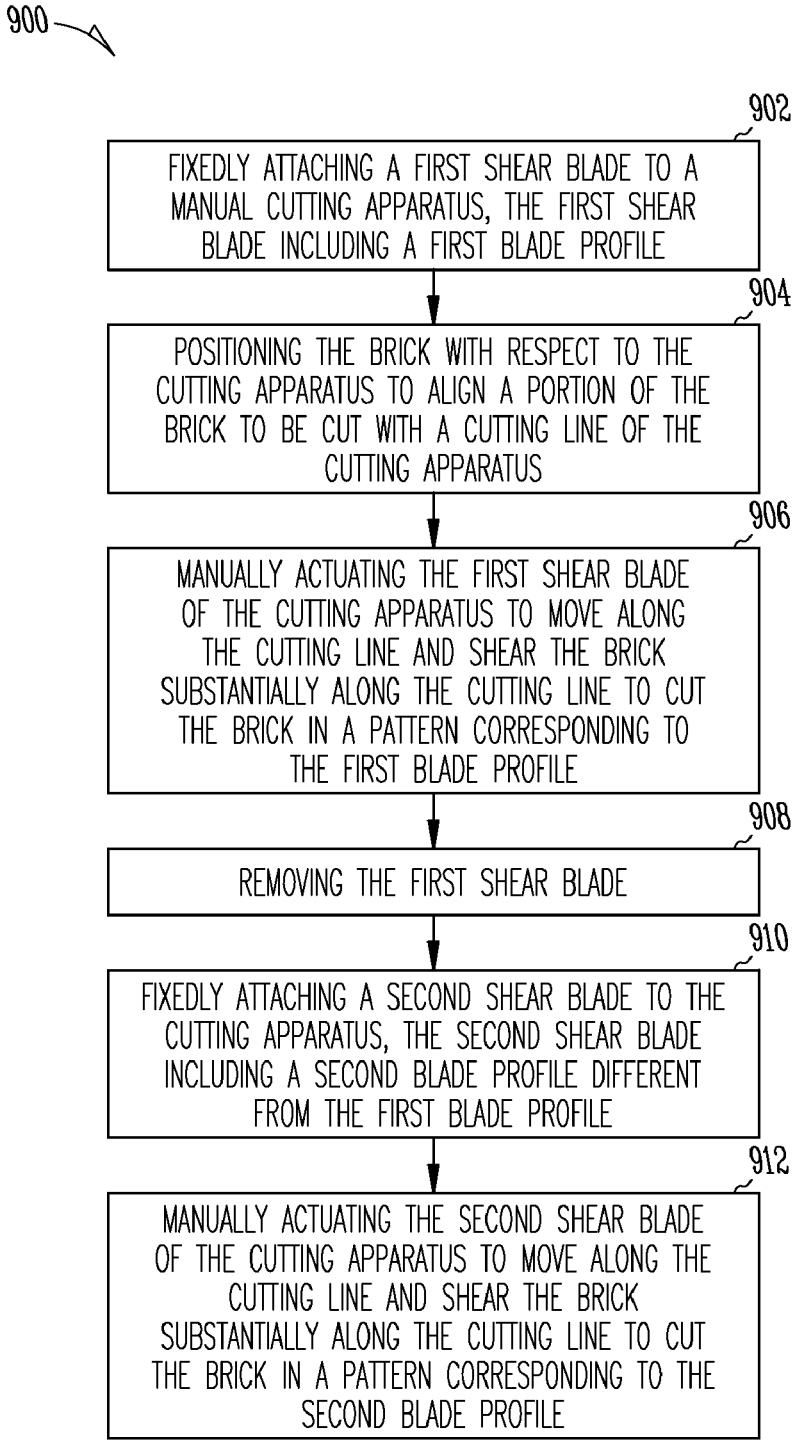
FIG. 9 is a diagrammatic view of a method of cutting a brick according to some embodiments of the disclosed subject matter.

With continued reference to FIGS. 1-7 and the above description, in a further example, a method 900 of cutting a brick 100 is shown in FIG. 9. The method 900 can be used to make differently shaped cuts in the same brick 100 or to make differently shaped cuts in different bricks 100. At 902, a first shear blade 220 is fixedly attached to a manual cutting apparatus 200. In an example, the first shear blade 220 includes a first blade profile. At 904, the brick 100 is positioned with respect to the cutting apparatus 200 to align a portion of the brick 100 to be cut with a cutting line 230 of the cutting apparatus 200. At 906, the first shear blade 220 of the cutting apparatus 200 is manually actuated to move along the cutting line 230 and shear the brick 100 substantially along the cutting line 230 to cut the brick 100 in a pattern corresponding to the first blade profile. At 908, the first shear blade is removed from the cutting apparatus 200. At 910, a second shear blade 220 is fixedly attached to the cutting apparatus 200. In an example, the second shear blade 220 including a second blade profile different from the first blade profile. For instance, the first and second blade profiles can include any of the cutting edges 310, 320, 330, 340 shown in FIGS. 3-6, or any other contemplated shapes. At 912, the second shear blade 220 of the cutting apparatus 100 is manually actuated to move along the cutting line 230 and shear the brick 100 substantially along the cutting line 230 to cut the same brick 100 or a different brick 100 in a pattern corresponding to the second blade profile.

In further examples of the method 900, manually actuating the first and second shear blades 220 includes actuating of a mechanical advantage device 216, as described above, to provide sufficient force to press the first and second shear blades 220 through the brick 100. In still further examples of the method 900, manually actuating the first and second shear blades 220 includes rotating a lever arm 208.

From the examples described above, it should be evident that the apparatus 200 described is believed to be advantageous in many respects. For instance, in some examples, the apparatus 200 is constructed to be relatively small and relatively light using various lightweight materials in its manufacture in order to facilitate transportation and carrying of the apparatus 200. In further examples, the apparatus 200 is fairly versatile in that it can be configured to cut variously shaped cuts using different shear blades 220 at various angles by adjusting the orientation of the cutting line 230 about the axes 201, 203 with respect to the base 202, platform 212, or other surface configured to support a brick 100 during a cutting operation. In other examples, the apparatus is configured to produce a relatively long stroke (sufficient to cut through a brick 100 of a height H) while maintaining a sufficient cutting force to move a shear blade 220 through the brick 100. In still further examples, the apparatus 200 is believed to be advantageous because it can be manually powered and does not require a source of electricity to operate. Although various advantages are presented herein, these advantages are not intended to be all inclusive, as further advantages other than those specifically presented herein may become evident.

ADDITIONAL NOTES

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown and described. However, the present inventor also contemplates examples in which only those elements shown and described are provided.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

What is claimed is:

1. An apparatus for cutting a brick, the apparatus comprising:

a base configured to selectively support the brick;

an arm pivotably attached to the base, the arm being pivotable about an axis substantially parallel to the base;

an actuating assembly attached to the arm and movable along a cutting line of direction relative to the brick, the actuating assembly movable by a cutting distance at least equal to a height of the brick, wherein the arm is pivotable with respect to the base to one or more configurations between a first configuration in which the cutting line is perpendicular to the base and a second configuration in which the cutting line is substantially parallel to the base; and a shear blade removably attached to the actuating assembly, the shear blade movable with the actuating assembly along the cutting line, the shear blade configured to shear the brick along the cutting line when moved toward the base through the brick.

2. The apparatus of claim 1, wherein the actuating assembly is manually powered to move along the cutting line.

3. The apparatus of claim 2, comprising a mechanical advantage device configured to increase force exerted by the shear blade on the brick during cutting, the force being sufficient to shear the brick.

4. The apparatus of claim 3, wherein the mechanical advantage device includes a reduction gearbox.

5. The apparatus of claim 3, wherein the mechanical advantage device includes a lever arm.

6. The apparatus of claim 1, wherein the shear blade includes a substantially straight cutting edge.

7. The apparatus of claim 1, wherein the shear blade includes an angled cutting edge.

8. The apparatus of claim 1, wherein the shear blade includes a curved cutting edge.

9. The apparatus of claim 1, wherein the shear blade includes a cutting edge having a first shape, and wherein the shear blade is configured to be removed from the actuating assembly and replaced with a second shear blade including a cutting edge having a second shape.

10. The apparatus of claim 1, wherein the actuating assembly is selectively pivotable with respect to the base.

11. The apparatus of claim 10, wherein the actuating assembly is selectively pivotable about an axis substantially normal to the base.

12. The apparatus of claim 1, wherein an angle of the cutting line is selectively adjustable with respect to the base.

13. A method of cutting a polymeric brick, comprising:

positioning the polymeric brick with respect to a cutting apparatus to align a portion of the polymeric brick to be cut with a cutting line of direction of the cutting apparatus relative to the polymeric brick, wherein the cutting apparatus includes an arm pivotably coupled with a base, the arm including a shear blade movable along the cutting line, the polymeric brick being positioned on the base of the cutting apparatus;

adjusting an angle of the cutting line including pivoting the arm of the cutting apparatus with respect to the base, the angle of the cutting line being adjustable to one or more configurations between a first configuration in which the cutting line is perpendicular to the base and a second configuration in which the cutting line is substantially parallel to the base; and actuating the shear blade of the cutting apparatus to move along the cutting line and shear the polymeric brick substantially along the cutting line, wherein actuating the shear blade includes actuating a mechanical advantage device to provide sufficient force to press the shear blade through the polymeric brick.

14. The method of claim 13, comprising fixedly attaching the shear blade to the cutting apparatus.

15. The method of claim 14, comprising removing the shear blade and replacing with a different shear blade having a profile different than a profile of the removed shear blade.

16. The method of claim 13, comprising selectively pivoting the shear blade with respect to the polymeric brick to adjust the cutting line with respect to the polymeric brick.

17. The method of claim 13, wherein actuating the shear blade includes rotating a lever arm.

18. The method of claim 13, wherein actuating the shear blade includes moving the shear blade by a cutting distance at least equal to a height of the polymeric brick.

19. The method of claim 13, wherein actuating the shear blade includes manually actuating the shear blade.

20. A method of cutting a brick, comprising:

fixedly attaching a first shear blade to a manual cutting apparatus, the first shear blade including a first blade profile;

positioning the brick with respect to the cutting apparatus to align a portion of the brick to be cut with a cutting line of direction of the cutting apparatus relative to the brick, wherein the cutting apparatus includes an arm pivotably coupled with a base, the arm including the first shear blade movable along the cutting line, the brick being positioned on the base of the cutting apparatus;

adjusting an angle of the cutting line including pivoting the arm of the cutting apparatus with respect to the base, the angle of the cutting line being adjustable to one or more configurations between a first configuration in which the cutting line is perpendicular to the base and a second configuration in which the cutting line is substantially parallel to the base;

manually actuating the first shear blade of the cutting apparatus to move along the cutting line and shear the brick substantially along the cutting line to cut the brick in a pattern corresponding to the first blade profile;

removing the first shear blade;

fixedly attaching a second shear blade to the cutting apparatus, the second shear blade including a second blade profile different from the first blade profile; and manually actuating the second shear blade of the cutting apparatus to move along the cutting line and shear the brick substantially along the cutting line to cut the brick in a pattern corresponding to the second blade profile.

21. The method of claim 20, wherein manually actuating the first and second shear blades includes actuating of a mechanical advantage device to provide sufficient force to press the first and second shear blades through the brick.

22. The method of claim 20, wherein manually actuating the first and second shear blades includes rotating a lever arm.

* * * * *